US005383796A

United States Patent [19]

Bowen et al.

[11] Patent Number: 5,383,796

[45] Date of Patent: Jan. 24, 1995

[54] ELECTRICAL CONNECTOR WITH IMPROVED STRAIN RELIEF MEANS

[75] Inventors: David C. Bowen, Downers Grove; Jerry A. Long, Elgin, both of Ill.

[73] Assignee: Molex Incorporated, Lisle, Ill.

[21] Appl. No.: 158,136

[22] Filed: Nov. 24, 1993

[51] Int. Cl.[6] ..... H01R 13/595

[52] U.S. Cl. ..... 439/469

[58] Field of Search ..... 439/469, 470, 472

[56] References Cited

U.S. PATENT DOCUMENTS

| | | | |
|---|---|---|---|
| 4,842,547 | 6/1989 | Defibaugh et al. | 439/460 |
| 4,952,168 | 8/1990 | Schieferly et al. | 439/467 |
| 5,195,909 | 3/1993 | Huss, Jr. et al. | 439/465 |

FOREIGN PATENT DOCUMENTS

| | | | |
|---|---|---|---|
| 8707443 | 12/1987 | WIPO | 439/469 |

*Primary Examiner*—Eugene F. Desmond
*Attorney, Agent, or Firm*—A. A. Tirva

[57] ABSTRACT

An electrical connector includes a shell having a cavity and a cable-receiving opening adapted to receive an electrical cable. The opening defines an axis, and a pair of screw posts are located in the cavity spaced on opposite sides of the axis such that the cable can be positioned therebetween. A cable clamp member includes a center section adapted to embrace one side of the cable, and a pair of wing sections extending from the center section and having screw-receiving holes alignable with the screw posts. The clamp member includes flanges projecting from the wing sections, with the flanges having slots for embracing ribs on the shell to preposition the cable clamp member over the cable with the screw-receiving holes aligned with the screw posts.

6 Claims, 4 Drawing Sheets

16
12
12
22
24
20
22
24
14
18
10

ELECTRICAL CONNECTOR WITH IMPROVED STRAIN RELIEF MEANS

FIELD OF THE INVENTION

This invention generally relates to the art of electrical connectors and, particularly, to a strain relief means for clamping an electrical cable exiting a connector.

BACKGROUND OF THE INVENTION

When the conductors of a cable are electrically terminated to contacts on a connector, strain relief arrangements are utilized to prevent forces on the cable from being transmitted to the conductor/contact terminations. The cable typically is secured to a connector housing or shell to transfer the forces to which the cable is subjected to the housing or shell. Typically, a strain relief arrangement will grip, compress or clamp the cable.

Often, strain relief clamping arrangements are provided in connectors which have housings or shells fabricated of a plurality of components. For instance, a typical housing might include two housing halves which are securely assembled together. In assembly, the housing halves, themselves, may be used to clamp the cable therebetween and, thereby, provide strain relief between the cable and the housing. A problem with such cable clamping arrangements is that the cable is "blindly" located between the housing halves. In other words, as the housing halves are clamped together, proper or improper positioning of the cable and the conductors thereof within the housing cannot be seen during assembly. In some such housing constructions, it simply is extremely difficult to manipulate the cable while simultaneously manipulating the housing components.

Consequently, the use of separate clamps for providing strain relief functions and for clamping an electrical cable to a housing or shell component has become well known in the art. A typical cable clamp includes a center section adapted to embrace one side of the cable. For instance, the center section may be arcuately formed to accommodate a round cable. A pair of coplanar wing sections extend from opposite sides of the center section, and each wing section has a hole to accommodate a fastening screw which is screwed into one of a pair of screw posts spaced on opposite sides of the cable. A continuing problem with these types of separate cable clamps is in prepositioning the clamp with its openings aligned with the screw posts, while at the same time maintaining proper relative positioning between the cable and the housing, and still be able to manipulate the screws for insertion through the holes in the clamp and into the screw posts of the housing.

In other words, once a cable is positioned between the spaced-apart screw posts of the housing, the clamp is placed over the cable and the clamp may be properly located generally laterally of the cable. However, even if the clamp is properly located in a lateral direction, there is no way to properly locate the clamp in the axial direction without gripping the clamp and the cable at the same time, while leaving only one hand of an operator to manipulate both the screws and a screw driver. For most operators, this is a very tedious and frustrating assembly procedure. The present invention is directed to solving such problems in an electrical connector having a strain relief arrangement.

SUMMARY OF THE INVENTION

An object, therefore, of the invention is to provide an improved cable strain relief system in an electrical connector.

In the exemplary embodiment of the invention, the electrical connector includes a housing or shell means having a cavity and a cable-receiving opening adapted to receive an electrical cable. The cable-receiving opening defines an axis. A pair of screw posts are located in the cavity spaced on opposite sides of the axis such that the cable can be positioned therebetween. A cable clamp member is provided with a center section adapted to embrace one side of the cable. A pair of wing sections extend from the center section and have screw-receiving holes alignable with the screw posts.

Generally, the invention contemplates the provision of complementary interengaging positioning means between the shell means and the cable clamp member for prepositioning the cable clamp member over the cable with the screw-receiving holes aligned with the screw posts. Therefore, with the cable clamp member properly prepositioned, the hands of an operator are free to manually manipulate the screws and an appropriate tool, such as a screw driver, to tighten the clamp member into strain relief condition compressing the cable.

As disclosed herein, the complementary interengaging positioning means include flanges projecting from the wing sections of the cable clamp member. The flanges include slots for embracing ribs on the shell means. The flanges are disposed generally in planes parallel to the axis of the cable-receiving opening, and the ribs are disposed generally transverse to the axis. The wing sections are generally coplanar in a plane which intersects the axis when the cable clamp member is fully clamped to the shell means. The center section of the clamp member is semi-cylindrical to accommodate a conventional round cable, and the clamp member is disclosed herein as being stamped and formed of sheet metal material.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
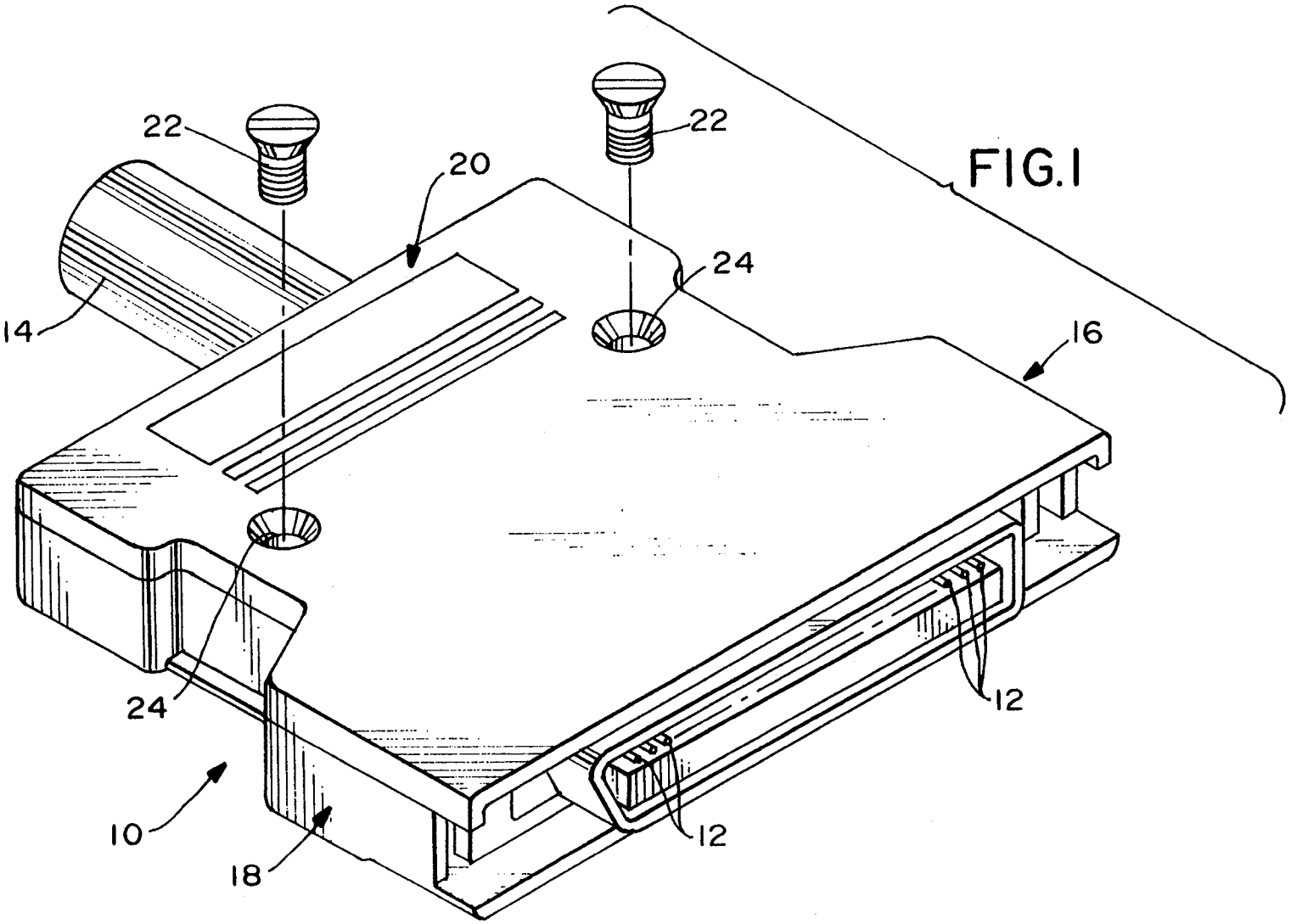
FIG. 1 is a perspective view of an electrical connector of a type for embodying the concepts of the invention.

Referring to the drawings in greater detail, and first to FIG. 1, the invention is incorporated in an electrical connector, generally designated 10, which has a plurality of contacts 12 electrically terminated to the conductors of an electrical cable 14. The connector includes a housing or shell means, generally designated 16, which includes a base part, generally designated 18, and a top part, generally designated 20. Actually, the top part simply is generally planar and defines a cover for the base part in which the interior components of the connector are located. The cover part and the base part are secured together in assembled condition, as shown, by a pair of fasteners in the form of screws 22 inserted through holes 24 in the cover part and screwed into screw posts (not visible) projecting from the inside of base part 18.

It should be understood that the cable clamp system of the invention has a wide range of applications, including but not limited to electrical connectors having two-part housings as described above and shown in FIG. 1. In fact, the two-part housing shown in FIG. 1 is in the form of a shell means which also shields the conductor/contact terminations therewithin, and the two parts of the shell means may be fabricated of such materials as an aluminum alloy or the like.

Figure 2:
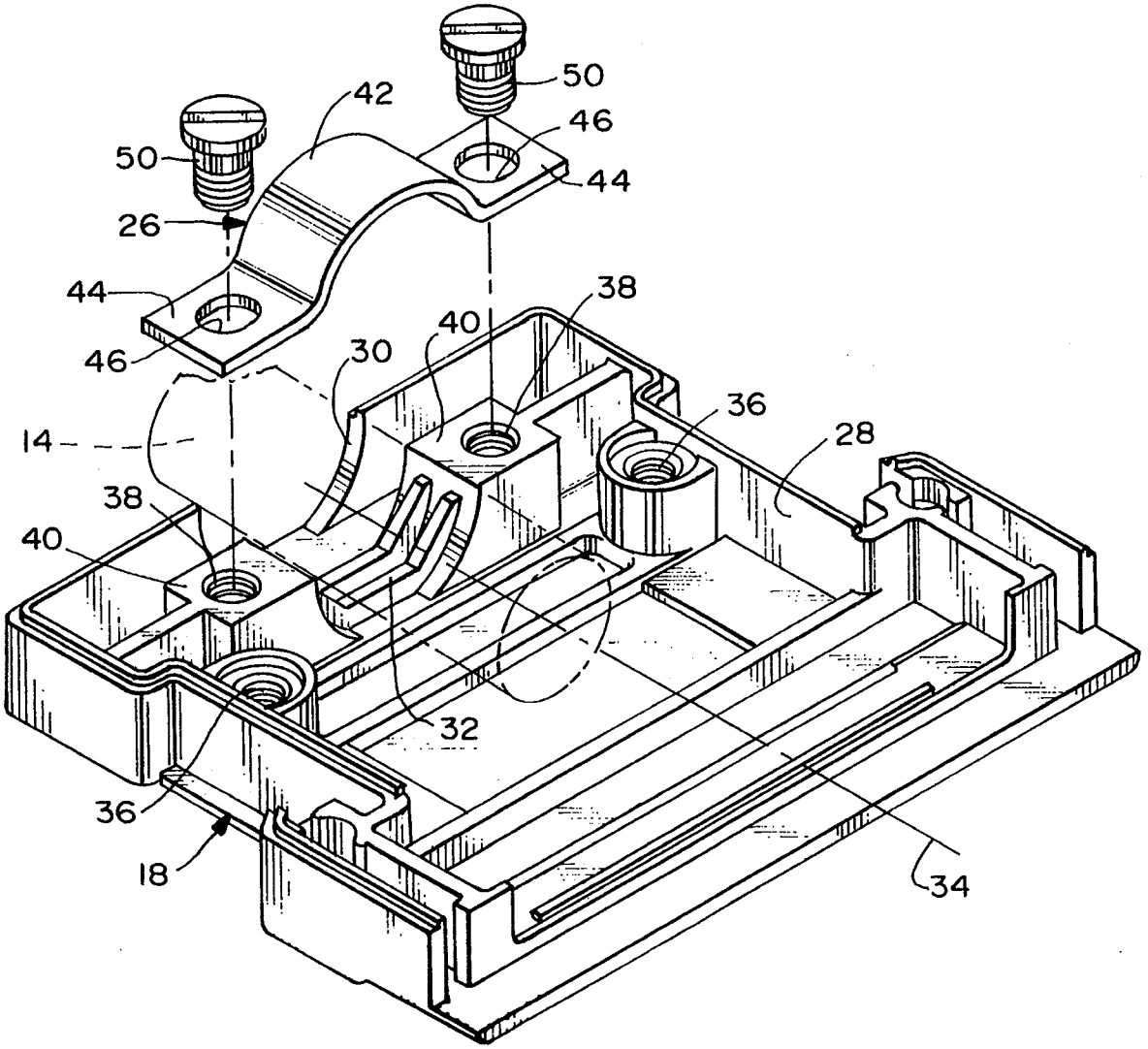
FIG. 2 (PRIOR ART)
FIG. 2 is a perspective view of one part of a connector housing and showing a cable clamp member which is typical of the prior art.

FIG. 2 shows a housing part 18 in conjunction with a cable clamp member, generally designated 26, which is typical of the prior art. The housing defines a cavity 28 and includes a cable-receiving opening or cable exit 30 adapted to receive cable 14 which is shown in phantom. The cable-receiving opening, along with an interior saddle 32, define an axis 34 which coincides with the axial center-line of the cable when the cable is properly positioned and clamped within the connector. Housing part 18 includes a pair of internally threaded screw posts 36 for receiving screws 22 (FIG. 1). The housing also has a pair of internally threaded screw posts 38 in cavity 28 spaced on opposite sides of axis 34 such that cable 14 can be positioned therebetween. The tops of the screw posts have generally flat mounting surfaces 40 which are coplanar.

Cable clamp member 26 of the prior art, as shown in FIG. 2, includes a center section 42 and a pair of wing sections 44 projecting outwardly from opposite sides of the center section. The center section is arcuately shaped to accommodate a conventional round cable. The wing sections are generally coplanar and include screw-receiving holes 46 which are alignable with the internally threaded holes in screw posts 38.

In assembling the connector which includes a cable clamp arrangement of the prior art as shown in FIG. 2, cable 14 first is positioned in opening 30 and saddle 32, and the conductors of the cable are terminated to contacts 12 (FIG. 1) of the connector. Cable clamp member 26 then is positioned over the cable, with center section 42 embracing the cable. Presumably, holes 46 in the clamp are transversely aligned with screw posts 38, although even this alignment may not be absolutely certain. In other words, if cable 14 is properly located on axis 34, holes 46 should be aligned with screw posts 38 in a direction generally perpendicular to axis 34. However, there is no provision for aligning the holes in the cable clamp with the screw posts in a direction generally axially of the cable, i.e. along the length of the cable generally parallel to axis 34. This causes continuing problems because the operator still must be able to manually manipulate a pair of screws 50 and an appropriate tool or screw driver in order to secure the clamp.

Figure 3:
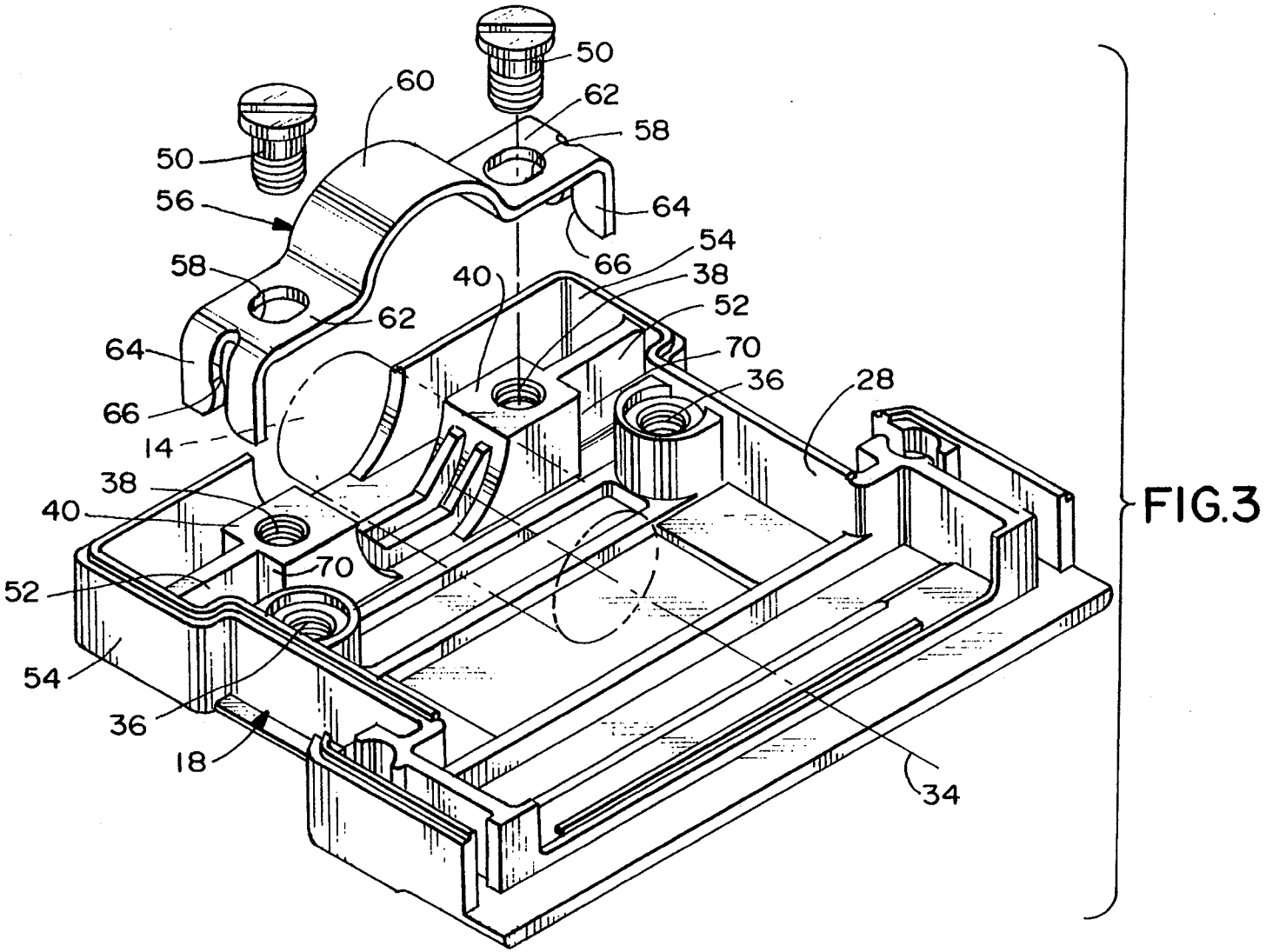
FIG. 3 is a view similar to that of FIG. 2, showing the cable clamp system of the invention, with the cable clamp member elevated above the housing part in an inoperative position.
Figure 4:
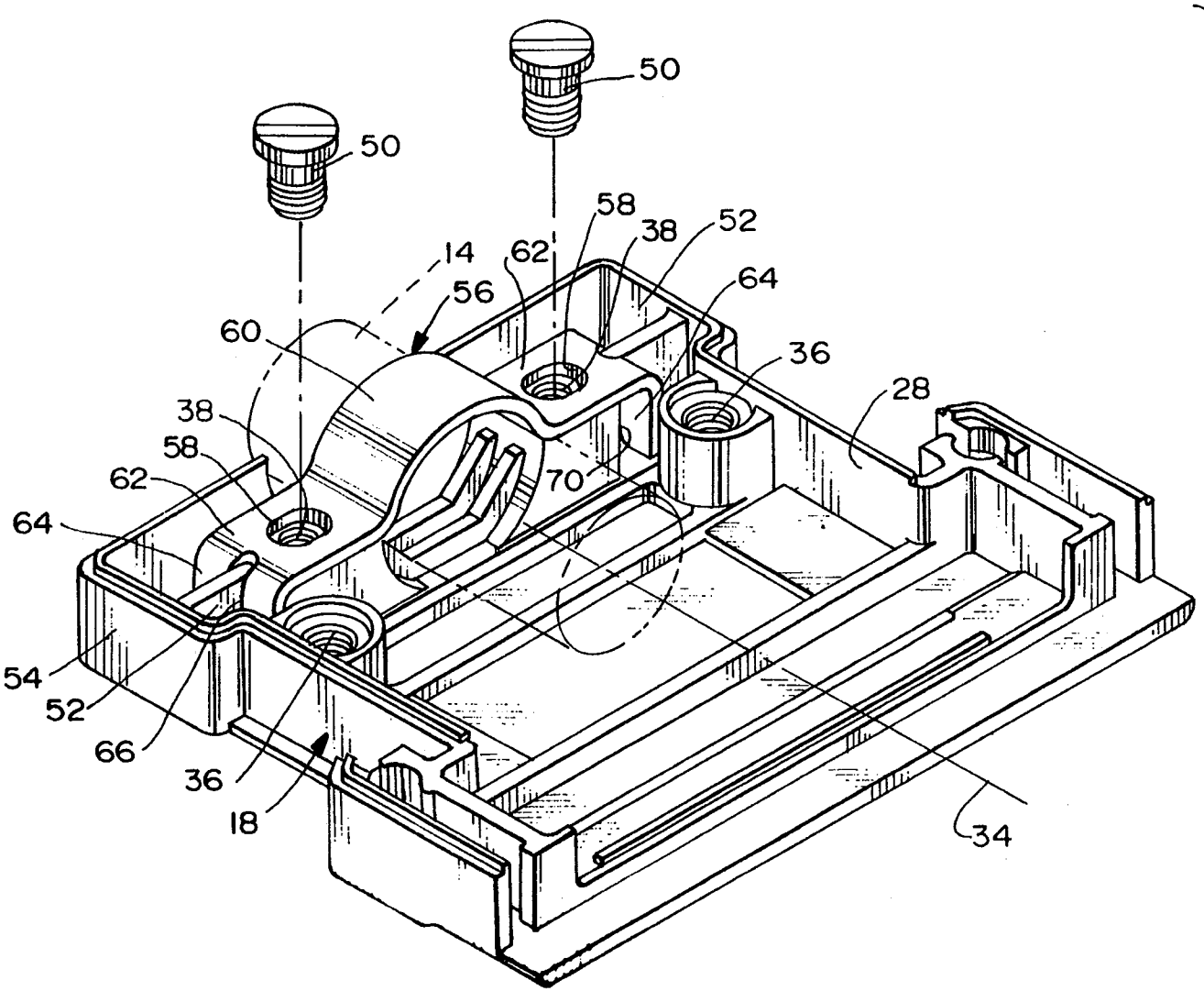
FIG. 4 is a view similar to that of FIG. 3, with the cable clamp member in its clamping position.

FIGS. 3 and 4 show the cable clamping system of the invention, and housing part or shell means 18 is shown substantially identical to that illustrated in FIG. 2 and described above, in order to facilitate the illustration. Therefore, like numerals have been applied in FIGS. 3 and 4 corresponding to those components described above and illustrated in FIG. 2. However, it also should be noted that a pair of ribs 52 radiate outwardly from internally threaded screw posts 38. It can be seen that the ribs are integral with the screw posts, as well as being integral with a pair of side walls 54 of the housing part. The entire housing part or shell means 18 can be unitarily cast of the aluminum alloy material, for instance.

The invention contemplates the provision of complementary interengaging positioning means between a cable clamp member, generally designated 56, and housing part 18 for prepositioning the cable clamp member over cable 14 with screw-receiving holes 58 in the cable clamp member properly aligned with screw posts 38.

More particularly, cable clamp member 56 of the present invention is similar to cable clamp member 26 (FIG. 2) of the prior art in that it includes an arcuately shaped center section 60 and a pair of outwardly extending wing sections 62, with screw-receiving holes 58 in the wing sections. However, cable clamp member 56 also includes a pair of flanges 64 projecting downwardly generally at right angles to wing sections 62. The flanges have slots 66 for embracing ribs 52 of housing part 18. With the cable clamp member properly oriented as shown in FIGS. 3 and 4, flanges 64 are oriented generally parallel to axis 34, with ribs 52 radiating generally perpendicular or transverse to the axis. Wing sections 62 are generally coplanar for engaging the coplanar mounting surfaces 40 of screw posts 38, with the plane of mounting surfaces 40 intersecting axis 34. The cable clamp member is unitarily fabricated of stamped and formed sheet metal material. Therefore, the cable clamp system of the invention is readily applicable for clamping a shield, such as a braid, of cable 14 between the metallic cable clamp member and the metallic housing part 18 which, thereby, would form a shield or "back shell" of the connector.

Lastly, FIG. 4 shows cable clamp member 56 in proper clamping position on housing part or shell means 18. It can be seen that screw-receiving holes 58 in the cable clamp member are precisely aligned with the internally threaded holes in screw posts 38 in both the lateral and axial directions relative to axis 34 and cable 14. The cable clamp member cannot move away from that precise position in the axial direction because of the interengagement between slots 66 of the clamp member and ribs 52 of the shell means. In fact, the cable clamp member cannot move in the lateral direction because of the engagement of flanges 64 and the outside surfaces 70 of screw posts 38, as shown. With this system, it is readily apparent that both hands of an operator are free to manipulate screws 50 and a screw driver to finish the clamping operation and provide strain relief on cable 14.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In an electrical connector which includes a shell means having a cavity and a cable-receiving opening adapted to receive an electrical cable, the cable-receiving opening defining an axis, and a pair of screw posts in the cavity spaced on opposite sides of the axis such that the cable can be positioned therebetween, and a cable clamp member having a center section adapted to embrace one side of the cable, and a pair of wing sections extending from the center section and having screw-receiving holes alignable with said screw posts, wherein the improvement comprises:

complementary interengaging positioning means between the shell means and the cable clamp member for prepositioning the cable clamp member over the cable with the screw-receiving holes aligned with the screw posts, wherein said complementary interengaging positioning means include flanges projecting from the wing sections, and said flanges include slots for embracing ribs on the shell means.

2. In an electrical connector as set forth in claim 1, wherein said flanges projecting from the wing sections are located for engaging outside surfaces of said screw posts to prevent relative movement between the cable clamp member and the shell means transversely of said axis.

3. In an electrical connector as set forth in claim 1, wherein said flanges are disposed generally in planes parallel to said axis, and said ribs are disposed generally transverse to the axis.

4. In an electrical connector as set forth in claim 3, wherein said wing sections are generally coplanar in a plane which intersects the axis when the cable clamp member is fully clamped to the shell means.

5. In an electrical connector as set forth in claim 4, wherein said center section is semi-cylindrical.

6. In an electrical connector as set forth in claim 5, wherein said cable clamp member is stamped and formed of sheet metal material.

* * * * *